United States Patent [19]

Gusman

[11] Patent Number: 4,703,530

[45] Date of Patent: Nov. 3, 1987

[54] FITTED SHEET

[75] Inventor: Irwin J. Gusman, New York, N.Y.

[73] Assignee: J. P. Stevens & Co., Inc., New York, N.Y.

[21] Appl. No.: 826,962

[22] Filed: Feb. 7, 1986

Related U.S. Application Data

[63] Continuation of Ser. No. 578,064, Feb. 8, 1984, abandoned.

[51] Int. Cl.[4] ..... A47G 9/04; A47C 31/00

[52] U.S. Cl. ..... 5/497; 5/499

[58] Field of Search ..... 5/482, 495, 501; 297/219, 224, 225

[56] References Cited

U.S. PATENT DOCUMENTS

| | | | |
|---|---|---|---|
| 1,820,104 | 8/1931 | Whaley | 5/496 |
| 2,569,627 | 10/1951 | Black | 5/497 |
| 3,013,283 | 12/1961 | Steffinich | 5/497 |
| 3,438,068 | 4/1969 | Anderson et al. | 5/497 |
| 3,868,735 | 3/1975 | Ross | 5/497 |

*Primary Examiner*—Alexander Grosz
*Assistant Examiner*—Michael F. Trettel
*Attorney, Agent, or Firm*—Leitner, Greene & Christensen

[57] ABSTRACT

A fitted sheet is disclosed having an edge elastic sewn to the lower edge of the open bottom. Elastics sewn in the corner seams extend from the top of the sheet to the edge. The sheet may be applied to mattresses of different thicknesses in the same nominal size without bunching or excessive tucking.

3 Claims, 5 Drawing Figures

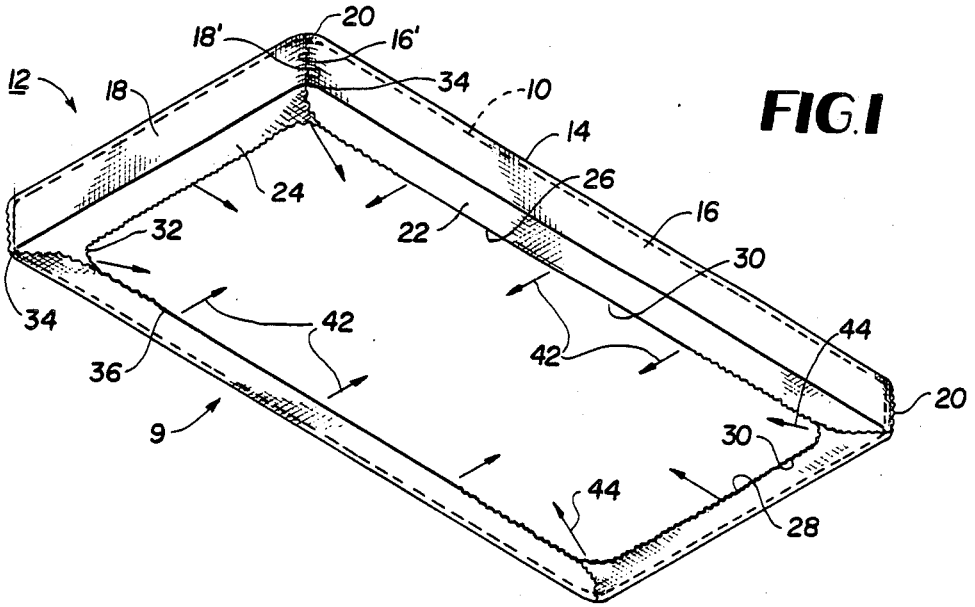
FIG.1
FIG.2
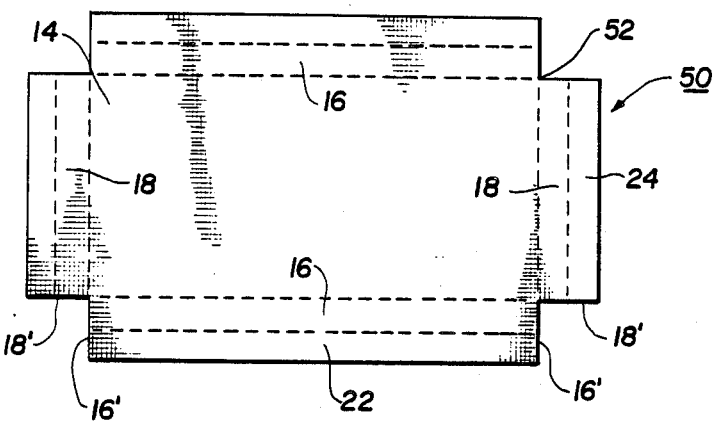
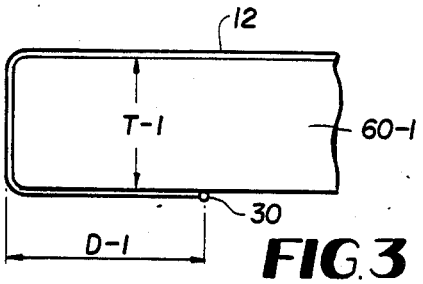
FIG.3
FIG.5
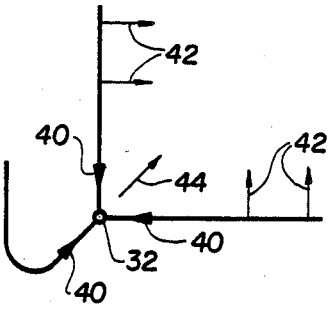
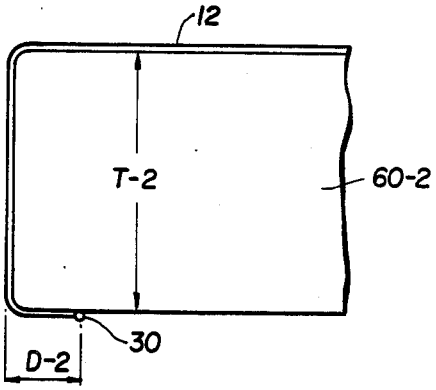
FIG.4

FITTED SHEET

This is a continuation of application Ser. No. 578,064, filed Feb. 8, 1984, now abandoned.

BACKGROUND

The invention is related to bedsheets and more particularly to bedsheets known as fitted sheets, which are adapted to partially enclose a mattress and to be held neatly in position on the mattress.

In order to apply and remove fitted sheets from a mattress, it is usually necessary to fold or distort the mattress considerably, particularly at the corners, which requires a considerable amount of effort and labor. Moreover, there is a tendency for a sheet to rip due to the great amount of strain caused by fitting the sheet over and removing it from the corners of the mattress. This problem has been addressed in U.S. Pat. No. 3,114,156 to J. L. Cobb, and assigned to the assignee herein. The Cobb design teaches the use of a triangular elastic gusset near each of the corners of retaining flaps disposed on the underside of the mattress when the sheet is in place. However, portions of the retaining flaps intermediate the triangular gussets must be manually tucked and pulled when the sheet is applied in order to eliminate wrinkles and bunching of the fabric. This problem has been helped somewhat by elastic sewn to the margins of the flaps along the short side of the sheet and partially along the long side. However, problems of alignment and bunching persist.

An even more troublesome problem with fitted sheets occurs because not all mattresses of the same nominal size (i.e., twin, double, queen and kind, etc.) are the same thickness. Mattresses in each of the aforementioned nominal sizes may vary, according to cost, from thickness as of about 6 inches to about 10 inches. It is difficult to make a conventional fitted sheet which will fit all the different mattress sizes in the nominal group.

Shallow or thin mattresses do not pull the sheet, and even with extensive tucking, the sheet will sag and wrinkle and hang loosely on the bed. High or thick mattresses (and box springs) require extra material so that the sheet does not pull out from the underside of the mattress. Also, difficulty has been experienced in applying a sheet to a thick mattress for just such a reason. Consequently, if the seam length, for the thickness of the mattress, is too short, one cannot get the sheet to fit on the mattress cover, for example, a 7 inch seam on a 9 inch thick mattress. If the seam is too long, the sheet sags, or wrinkles and does not lie smoothly on the bed.

Yet another problem with fitted sheets is the difficulty of preventing bunching in the corners, causing the formation of "ears" by the bunched material. This can occur especially when applying the sheet to a thin mattress.

The fitted sheet of the present invention is adapted to be easily applied on a mattress (or box springs) of a selected nominal size regardless of the thickness variations in such size. The sheet is adapted to be easily applied and to fit flatly on the mattress without bunching at the corners or along the sides and without sagging or forming wrinkles.

SUMMARY OF INVENTION

There has been provided a fitted sheet having top, side and end panels for covering the top sides and ends respectively of a mattress to which the sheet is to be applied. Extending from each of the side and end panels is a retaining flap or flap having a free marginal edge or edge forming a boundary for an open bottom of the sheet. The flaps may be tucked underneath the mattress to cooperate with the bottom surface thereof and to maintain the sheet in proper orientation with respect to the mattress. Adjacent ends of the flap are sewn together at a corner seam. An appropriate length of elastic material is sewn into the corner seams, each of which extend from the top of the sheet to the edge of the flaps. There is also provided appropriate length or lengths of elastic material sewn to the edges of the flaps from corner to corner of the end panels and over a selected length with the side panels extending from said corners.

The elastic material at the corners (hereinafter corner elastic) and along the flap edges (hereinafter edge elastic) is applied a manner such that the corner seam contracts toward the top of the sheet and the flap edges contract longitudinally, thereby drawing the corner seams and margin of the open bottom inwardly of the sheet.

When the fitted sheet is applied to the mattress, the edge elastic urges the flaps in tucking relation with the underside of the mattress for pulling the sheet flat on the mattress. Also, the corner elastic pulls the corner of the sheet towards the underside of the mattress whereby the sheet is properly oriented and lies flat on a mattress without bunching.

The sides and flaps are sufficiently long to extend beyond the sides of the mattress of any nominal thickness and into engagement with the underside of a relatively thick mattress in a nominal size range without undue strain on the sheet and without bending the mattress. However, the edge and corner elastics are sufficiently taut so that, when the fitted sheet is applied to a shallow or thin mattress, the elastic corner and edge elastics urge the sheet into engagement with the mattress without bunching. As a result, the sheet can be applied and removed from a mattress without undue strain and without folding or distorting the mattress or tearing the seam. Further, because of the elastic along portions of the margin of the open bottom and the corner elastics cooperating with the edge elastics, a full range of mattress sizes can be fitted by a "one-size" sheet within a nominal size for each fitted sheet without undue tucking and without undue wrinkling or bunching of the fabric, i.e., a "one-size" fitted sheet fits all mattresses.

DESCRIPTION OF THE DRAWINGS

FIG. 1 is a perspective view of the sheet fitted over a mattress.

FIG. 2 is a plan view of a blank from which the sheet embodying the invention is made.

FIGS. 3 and 4 are enlarged detailed views of a corner of the fitted sheet applied over different size mattresses.

FIG. 5 is a schematic diagram of the forces acting on the corner of the fitted sheet of the present invention.

DESCRIPTION OF THE PREFERRED EMBODIMENT

FIG. 1 illustrates a mattress 10 having a fitted sheet or sheet 12 embodying the invention applied thereon. The sheet 12 is provided with respective top, side and end panels, 14, 16 and 18, which overlie the top sides and ends of mattresses 10. Corners 20 are formed by connecting the adjacent ends 16' and 18' of respective side and end panels 16 and 18 by seaming. When the sheet 12 is placed on the mattress 10, the side and end panels 16 and 18 extend vertically from the top panel 14 and over the respective sides and ends of the mattress 10. Portions of the side and end panels 16 and 18, hereinafter referred to as retaining flaps or flaps 22 and 24 respectively, extend below the sides of the mattress 10 and lie against the underside thereof, forming an open bottom for the fitted sheet 12. The retaining flaps 22 and 24 have respective free edges or edges 26 and 28, which, when the fitted sheet is sewn together, form a peripheral margin 30 of the open bottom 9.

In order to resiliently maintain sheet 12 in proper orientation when placed on the mattress 10, each adjacent pair of ends 16' and 18' is connected at the corner seams 20 by an appropriate length of elastic material, hereinafter corner elastic 34. Likewise, the peripheral margin 30 has an appropriate length of the elastic material, hereinafter edge elastic 36, sewn thereto along selected portions of edges 26 and along the entire lengths of edges 28 of the respective side and panels 16 and 18. The corner and edge elastics 34 and 36 meet at junctures 32 of the corner seams 20 and the edges 26 and 28 as shown. In a preferred embodiment, the edge elastics 36 along edges 28 extend about 10–15" from corners 20.

As seen in FIGS. 1 and 5, the elastics 34 and 36 are constructed with a narrow fabric containing elastic yarns (not shown) which extend in a direction parallel to or along the respective corner seam 20 and the edges 26 and 28 to which they are attached. In FIG. 5, a schematic diagram of the resulting forces (arrows 40) of the elastics 34 and 36 acting on the corners 20 of the sheet 12 is shown. The forces 40 pull in the direction of the juncture 32 as shown by the arrow. As a result, the sides 16 and 18 of the sheet 12 and the corners 20 tend to be drawn towards the underside of the mattress 10 so that the top 14 of the sheet 12 lies flat.

There is sufficient elasticity in the elastics 34 and 36 so that each corner 20 of the sheet 12 may be drawn over the respective corners of the mattress 10 without folding or pulling the mattress 10 except a sufficient amount to urge the edges 26 and 28 under the same.

The edge elastic urges or pulls the edges 26 and 28 in a direction towards the junctures 32. Consequently, the edges 26 and 28 tend to move centrally of the underside 10 of the mattress 10 in the direction of the arrows 42. Similarly, the action of the edge elastics 36 tends to pull the junctures 32 and stretch the corner elastics 34 centrally of the underside 10 of the mattress in a direction of the arrows 44. This pulls the corners 20 in the same direction, and tends to pull the top 14 of the sheet flat against the upper side of the mattress. The edge elastics 36 also act upon the sheet 12 to urge the same snugly around sides and against the underside of the mattress 10.

The edge elastic 36 is sufficiently resilient and stretchable so that the sheet 12 may be removed from the mattress 10 without undue strain on the elastic material or on the fabric of the fitted sheet 12. In removing the sheet 12 from the mattress 10, the edge elastic 36 permits the retaining flaps 22 and 24 to be completely pulled from beneath the mattress. The sheet 12 may be easily removed by slipping corners 20 off the mattress 10 without interference of the retaining flaps 22 and 24.

Conversely, to apply the sheet to the mattress 10, the corner and edge elastics 34 and 36 easily stretch to allow the corners 20 to be slipped over the corners of the mattress 10, after which it is merely necessary to slide the flaps 22 and 24 under the mattress 10. The edge elastic 36 tends to pull the flaps 22 and 24 under the mattress 10 without undue tucking. The elastics 34 and 36 cooperate to self-align and pull the sheet 12 tightly into conformance with the mattress 10.

The sheet 12 may be constructed from a blank 50, illustrated in FIG. 2. The blank 50 is cut from a rectangular piece of sheet material. Side and end panels 16 and 18, ends 16' and 18', and side and end retaining flaps 22 and 24 respectively, are formed by cutting away, preferably square or nearly square, corners 52 from the blank 50. When the adjacent ends 16' and 18' are joined together with the corner elastic 34, as shown in FIG. 1, the corners 20 formed thereby tend to contract toward the top 14 of the sheet. When the edge elastics 36 are sewn along the edges 26 and 28 of the respective side and end panels 16 and 18, the edges 26 and 28 longitudinally contract and the corners 20 are drawn inwardly of the open bottom 9, as hereinbefore described.

FIGS. 3 and 4 illustrate examples of the versatility of the fitted sheet 12 of the present invention. In FIG. 3, a portion of a relatively shallow mattress 60-1, of a selected nominal size, is shown in schematic cross section (without cross hatching). The mattress 60-1 has a thickness T-1. The fitted sheet 12 is located on the mattress 60-1 and the peripheral margin 30 engages or overlaps the underside of the mattress 60-1 by a distance D-1, as shown.

In FIG. 4, a mattress 60-2 is the same nominal size as the mattress 60-1 in FIG. 3. However, the mattress 60-2 is a thickness T-2, which is greater than the thickness T-1 of the mattress 60-1. The sheet 12 may be applied to the mattress 60-2 in the same manner as hereinbefore described, except that the marginal edge 30 engages or overlaps with the underside of the mattress 60-2 by a distance D-2. Distance D-2 is smaller than the distance D-1 shown in the example of FIG. 3. The sum of the dimensions T-1 and D-1 is about equal to the sum of the dimensions T-2 and D-2. The sheet 12 is versatile because it can be applied to mattresses of different thicknesses. The corner elastic 34 pulls the sheet 12 downwardly and around the cooperating corner of the various mattress herein described. Similarly, the edge elastic 36 tends to pull the side and end panels 16 and 18 respectively about the sides of various mattresses. These forces tend to cause the top 14 of the sheet 12 to lie flat and into engagement with the mattress regardless of the mattress size. Likewise, the corners 20 tend to self-align.

In conventional fitted sheets, not having corner elastics 34, there is a tendency for such sheets to bunch in the corners, increasing the difficulty of applying the sheet properly to mattresses of relatively shallow thickness. The corner elastic 34 cooperates with the edge elastic 36 to pull the corners 20 and the top of the sheet 14 around the mattress sides and tightly against the mattress. Likewise, the retaining flaps 22 and 24 are drawn close to the underside of the mattress by the edge elastic 36 acting on the respective free edges 26 and 28 thereof. Overall, it is relatively easy to apply the sheet 12, and the sheet is neat and tight against the mattress 10.

There has therefore been provided a specific embodiment of a fitted sheet of the present invention capable of being relatively easily applied to mattresses of varying thickness in the same nominal size. It should be understood that the invention is not confined to the precise construction illustrated, and various modifications can be made without departing from the scope and spirit of the invention.

What is claimed is:

1. A fitted sheet comprising: A top panel, side panels and end panels for covering the top, sides and end respectively of a mattress, said side panels and end panels having straight adjacent ends seamed together to form corners extending from the top panel to free marginal edge or edges of the side panels and end panels, the sheet having fullness in the corners and adapted to extend beyond the bottom of the mattress to which it is applied, said side panels and end panels including retaining flap portions or flaps extending from a lower portion of said side panels and end panels to the respective free edge of each said side panels and end panels having fullness in the edges to form an open bottom of the sheet; corner elastic means in each of said corners extending along the seamed length of each corner wherein the resilient force of said elastic means is in a direction parallel to said corner seam for drawing the corners towards the top panel in order to take up fullness of said corners; and edge elastic means extending along entire edge margins of the respective end panels from corner to corner, and at least along selected portions of the side panels, and extending to the corners for drawing said edges inwardly of the top panel in order to take up fullness in said edges, said edge and corner elastic means meeting at the juncture of each respective corner and adjacent ends of the side panels and end panels for drawing the corners and the free edges laterally inwardly of the top panel of said fitted sheet, whereby when said sheet is in position on said mattress, said corner elastic means and said edge elastic means draw the retaining flaps against the underside of the mattress and draw the side panels and end panels and the top panel of the sheet tightly against the mattress without significant bunching, to thereby simultaneously take up fullness in the corners and adjacent edges, said corner and edge elastic means being extensible for removing the fitted sheet from the mattress wthout deforming the same.

2. A fitted sheet as defined in claim 1 in which the side panels and retaining flaps are of a length sufficient to engage the sides and underside of a relatively thick mattress of a given nominal size, and wherein the elasticity of the corner and edge elastic means is sufficient so that when the fitted sheet is applied to a mattress of a relatively lesser thickness than the aforementioned mattress, the respective side, end and top panels and the corners of the fitted sheet are drawn closely against said mattress without significant bunching.

3. A fitted sheet as defined in claim 1 wherein the edge elastic means extends along the side panels about 10 to 15 inches from each corner.

* * * * *